US009791815B2

(12) United States Patent
Igarashi

(10) Patent No.: US 9,791,815 B2
(45) Date of Patent: Oct. 17, 2017

(54) PRINTING APPARATUS, METHOD OF CONTROLLING THE SAME, AND COMPUTER-READABLE STORAGE MEDIUM

(71) Applicant: CANON KABUSHIKI KAISHA, Tokyo (JP)

(72) Inventor: Hiroya Igarashi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/752,587

(22) Filed: Jun. 26, 2015

(65) Prior Publication Data

US 2016/0011553 A1 Jan. 14, 2016

(30) Foreign Application Priority Data

Jul. 11, 2014 (JP) ..... 2014-143658

(51) Int. Cl.
*G03G 15/00* (2006.01)

(52) U.S. Cl.
CPC ..... *G03G 15/5008* (2013.01); *G03G 2215/00945* (2013.01); *G03G 2215/00949* (2013.01); *G03G 2215/0196* (2013.01)

(58) Field of Classification Search
CPC ..... G03G 15/50; G03G 15/5008; G03G 15/5033; G03G 15/505; G03G 15/553; G03G 2215/00097
USPC ..... 399/31, 43, 85
See application file for complete search history.

(56) References Cited

U.S. PATENT DOCUMENTS

| | | | | |
|---|---|---|---|---|
| 7,974,568 | B2 * | 7/2011 | Yamasaki et al. | 399/396 |
| 2001/0022900 | A1 * | 9/2001 | Sasame et al. | 399/25 |
| 2002/0174104 | A1 * | 11/2002 | Yokoyama | 707/1 |
| 2003/0182248 | A1 * | 9/2003 | Murata | G03G 21/02 705/400 |
| 2004/0126123 | A1 * | 7/2004 | Koga et al. | 399/24 |
| 2004/0223777 | A1 * | 11/2004 | Cao | G03G 15/205 399/68 |
| 2007/0092309 | A1 * | 4/2007 | Willemsens | G03G 15/0194 399/301 |
| 2010/0238484 | A1 * | 9/2010 | Komine | G06F 3/1204 358/1.15 |

FOREIGN PATENT DOCUMENTS

JP 2007-241412 A 9/2007

* cited by examiner

*Primary Examiner* — Benjamin Schmitt
(74) *Attorney, Agent, or Firm* — Fitzpatrick, Cella, Harper & Scinto

(57) ABSTRACT

A method of controlling a printing apparatus, comprises printing an image on a sheet; measuring a printing speed of the printing; and storing, for each printing speed measured in the measuring, a number of sheets printed in the printing.

6 Claims, 8 Drawing Sheets

FIG. 4

400

| 401 SPEED | 402 PRINT TYPE | 403 COUNTER |
|---|---|---|
| SPEED A | BLACK AND WHITE, SMALL | 00000000 |
| | BLACK AND WHITE, LARGE | 00000000 |
| | COLOR, SMALL | 00000000 |
| | COLOR, LARGE | 00000000 |
| SPEED B | BLACK AND WHITE, SMALL | 00120000 |
| | BLACK AND WHITE, LARGE | 00002000 |
| | COLOR, SMALL | 00010000 |
| | COLOR, LARGE | 00001000 |
| SPEED C | BLACK AND WHITE, SMALL | 00000000 |
| | BLACK AND WHITE, LARGE | 00000000 |
| | COLOR, SMALL | 00000000 |
| | COLOR, LARGE | 00000000 |

410

| 404 COMPONENT | 405 COMPONENT COUNTER |
|---|---|
| COMPONENT A | 00120000 |
| COMPONENT B | 00120000 |
| COMPONENT C | 00200000 |
| ... | ... |

FIG. 8

800

| 801 COMPONENT | 802 PRINT TYPE |
|---|---|
| COMPONENT A | BLACK AND WHITE, SMALL |
| | COLOR, SMALL |
| COMPONENT B | ALL |
| COMPONENT C | COLOR, SMALL |
| | COLOR, LARGE |
| ... | ... |

PRINTING APPARATUS, METHOD OF CONTROLLING THE SAME, AND COMPUTER-READABLE STORAGE MEDIUM

BACKGROUND OF THE INVENTION

Field of the Invention

The present invention relates to a printing apparatus which has an operation mode change discharge counter, a method of controlling the same, and a computer-readable storage medium.

Description of the Related Art

Conventionally, there are printing apparatuses capable of switching a printing speed by changing a rotating speed of a motor for driving a roller for conveying sheets, a motor for driving a photosensitive drum necessary for image formation, or the like. There are several reasons for switching the speed, but there are cases in which, for example, a speed of the printing apparatus is switched in accordance with usage conditions for a user that uses the printing apparatus. A technique for changing a charging amount in accordance with a printing speed in a printing apparatus capable of switching the printing speed in this way has been proposed in Japanese Patent Laid-Open No. 2007-241412.

However, there is a problem with the above described conventional technique as recited below. For example, there are cases in which the printing speed does not reach a desired speed such as a case where it is desired that the printing speed be switched in accordance with the needs of the user, and a case where a long time is required for RIP (Raster Image Processor) processing of a print job on an input side. In the above described conventional technique, the number of print sheets for each actual printing speed which may include a delay of image processing, or the like, is not understood. Also, regarding consumable parts whose behavior changes in accordance with the actual speed, a degree of use which corresponds to the speed cannot be understood.

SUMMARY OF THE INVENTION

The present invention enables realization of an arrangement for storing a print sheet number for each printing speed.

One aspect of the present invention provides a printing apparatus, comprising: a print unit configured to print an image on a sheet; a measurement unit configured to measure a printing speed of the print unit; a storage unit configured to store, for each printing speed measured by the measurement unit, a number of sheets printed by the print unit.

Another aspect of the present invention provides a method of controlling a printing apparatus, comprising: printing an image on a sheet; measuring a printing speed of the printing; and storing, for each printing speed measured in the measuring, a number of sheets printed in the printing.

Still another aspect of the present invention provides a non-transitory computer-readable storage medium storing a computer program for causing a computer to execute a method of controlling a printing apparatus, the method for controlling comprising: printing an image on a sheet; measuring a printing speed of the printing; and storing, for each printing speed measured in the measuring, a number of sheets printed in the printing.

Further features of the present invention will be apparent from the following description of exemplary embodiments with reference to the attached drawings.

BRIEF DESCRIPTION OF THE DRAWINGS

FIG. 4 is a view illustrating details of counter information.

FIG. 8 is a view illustrating a table associating components and print types.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

<System Configuration>

Firstly, an explanation will be given for a configuration of a component management system according to the present invention with reference to FIG. 1. In the present embodiment, explanation is given for an example of a component management system which includes printing apparatus main bodies and a management server.

Figure 1:
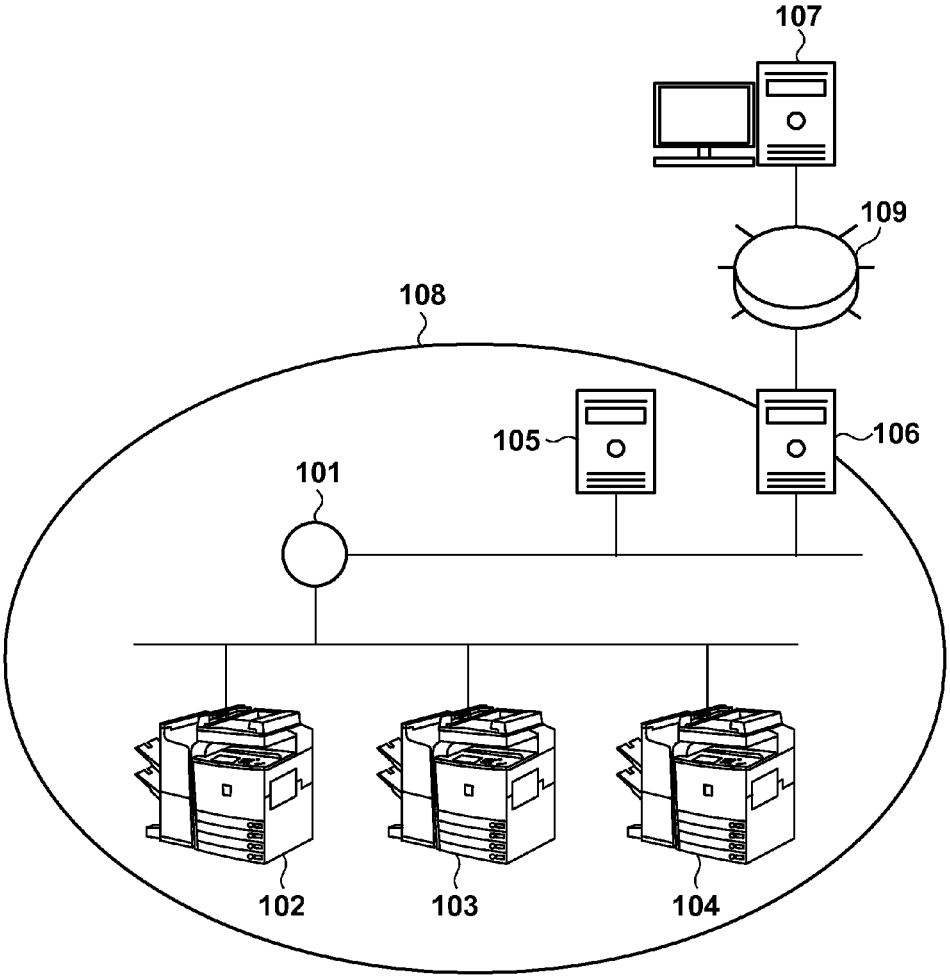
FIG. 1 is a view illustrating a configuration of a component management system.

In FIG. 1, reference numeral 101 denotes a local area network (LAN), and printing apparatuses 102-104 which a management server 107 manages as well as information processing apparatuses 105 and 106 are connected communicably thereto. Here, the information processing apparatus 105 functions as a Proxy Server, and the information processing apparatus 106 functions as a Firewall installed in order to raise security with respect to the Internet (Intranet) 109.

Furthermore reference numeral 107 denotes the management server, which manages operating states of the plurality of printing apparatuses 102-104 arranged within the firewall in a centralized fashion. Note that the management server 107 receives operation mode settings of the printing apparatuses 102-104, operation information such as counter values and operation logs, and failure information such as that regarding hardware malfunctions, the frequent occurrence of jams, or the like, and performs differing analysis function processing which is explained later. Also, the management server 107 performs automatic order management for consumable parts and components of the printing apparatuses 102-104.

Reference numeral 108 denotes an intranet environment, in which the printing apparatuses 102-104 and the information processing apparatuses 105 and 106 are comprised, connected to each other via the LAN 101. Note that in an actual device management system, a plurality of instances of the intranet environment 108 and the management server 107 may be connected to each other via the Internet 109.

The printing apparatuses 102-104 perform communication in accordance with their own communication schedules via the LAN 101. The printing apparatuses 102-104 process operation mode settings, operation information such as counter values and operation logs, and failure information regarding such things as hardware malfunctions and the frequent occurrence of jams, or the like, into data for communicating, and transmit the results to the management server 107 via the Internet 109.

Also, instructions for commands such as setting information update, reboot, or the like, are performed towards the printing apparatuses 102-104. Here the communication method is MIB (Management Information Base) exchange via SNMP (Simple Network Management Protocol), or the like.

The communication protocol is envisioned to be a protocol such as HTTP, HTTPS, or the like, but is not limited to these. For example, in the example of the device management system of FIG. 1, the printing apparatuses 102-104 transmit data to the management server 107 via the information processing apparatus 105 which functions as a proxy server and via the information processing apparatus 106 which functions as a firewall using HTTPS.

The management server 107 issues commands for the printing apparatuses 102-104 in order to control the printing apparatuses 102-104. The printing apparatuses 102-104 periodically (or according to instructions from the management server 107) perform command acquisition (hereinafter referred to as command request) towards the management server 107. Accordingly, commands issued by the management server 107 are stored in the management server 107 until the printing apparatuses 102-104 acquire them. For example, an approach to command acquisition is to perform https communication with the management server 107 by using SSL certificates stored within the printing apparatuses 102-104. Here, the management server 107 recognizes that the communication partner is a management target printing apparatus by starting communication using a particular SSL certificate.

Also, a monitoring apparatus for performing the following communication processing is arranged within the printing apparatuses 102-104, for example. Here, each monitoring apparatus is given an identification ID for unique identification, and after the https communication is established the identification ID is transmitted to the management server 107 using a protocol such as SOAP. With this it is possible for the management server 107 to identify which of the printing apparatuses 102-104 a communication was performed from. Also, the management server 107 is enabled to control the printing apparatuses 102-104 specifically from the Internet 109 by adding commands to a response to the identification ID.

<Printing Apparatus Hardware Configuration>

Figure 2:
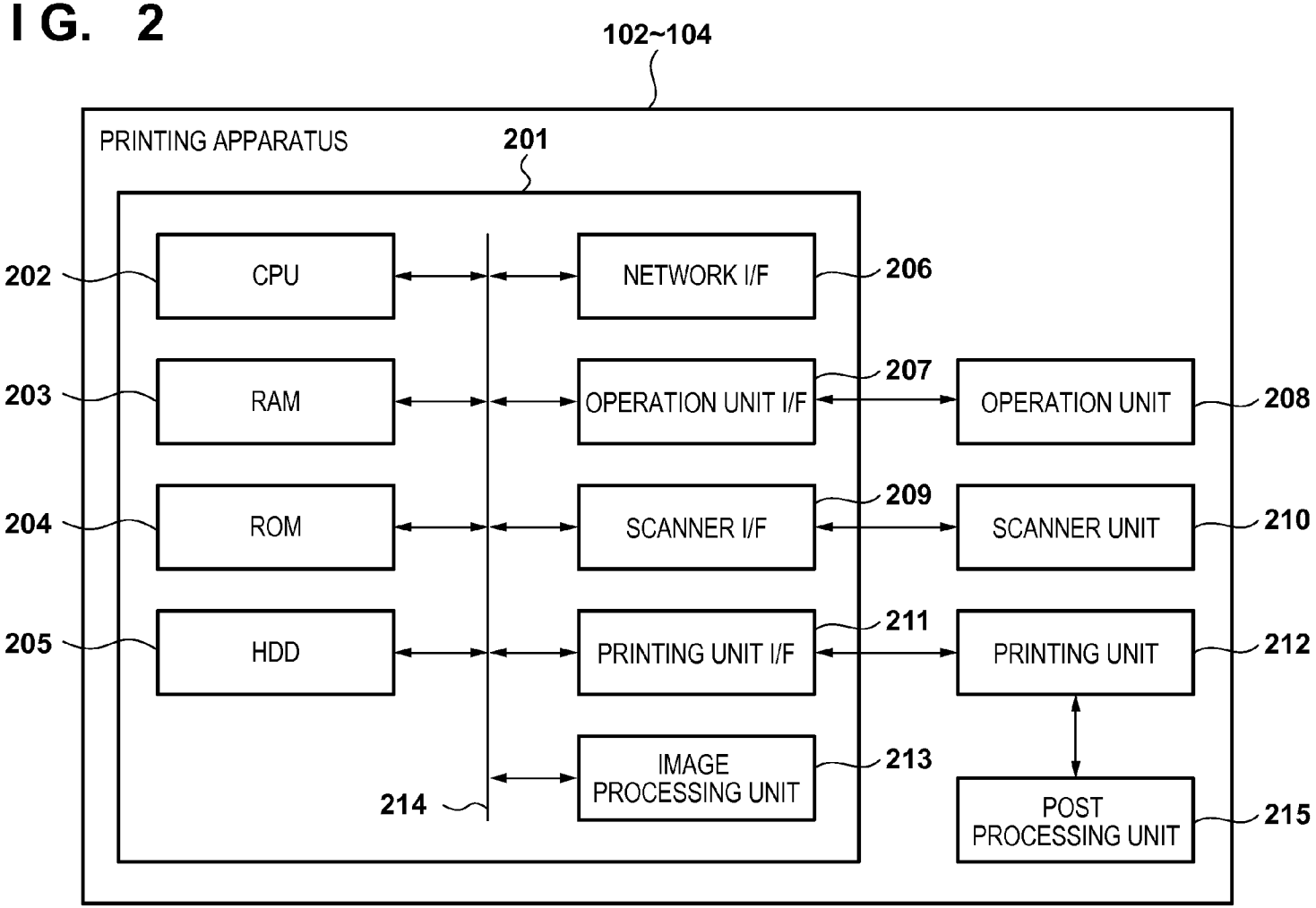
FIG. 2 is a view illustrating a hardware configuration of a printing apparatus.

Next, with reference to FIG. 2, explanation will be given for a hardware configuration of the printing apparatuses in the present invention. The printing apparatuses 102-104 comprise an image controller unit 201, an operation unit 208, a scanner unit 210, a printing unit 212, and a post processing unit 215.

A CPU 202 controls copying, printing from a host computer, or the like, by controlling comprehensively the devices connected to a system bus 214. A ROM 204 is a FlashROM, and various parameters and programs necessary for execution of the printing apparatus are held in the ROM 204; also the various parameters can be rewritten. A RAM 203 functions as a main memory or work area for the CPU 202, and also is used as a buffer region for image data such as that for scanning or printing. An HDD 205 temporarily stores print data received by a network I/F 206, and the HDD 205 is accessed from various modules as a swap region of an image processing unit 213. Also, setting values for the scanner unit 210, the printing unit 212, and the post processing unit 215, exchange target values for components, and counters are held in the HDD 205.

An operation unit I/F 207 is a communication I/F for controlling key input from the connected operation unit 208, and display output to the operation unit 208. The operation unit 208 is comprised of hardware keys and a touch panel, and the operation unit 208 is able to perform a display of statuses of the printing apparatuses 102-104, and perform operations. A scanner I/F 209 is a communication I/F for controlling the scanner unit 210 which is connected, and the scanner I/F 209 transmits/receives control commands of the scanner unit 210, and receives images that are scanned optically by the scanner unit 210. The scanner unit 210 optically scans originals. A printing unit I/F 211 is a communication I/F for controlling the printing unit 212 and the post processing unit 215, which are connected, and the printing unit I/F 211 transmits/receives control commands to/from the printing unit 212 and the post processing unit 215, and transmits images printed by the printing unit 212. The post processing unit 215 performs post-processing such as stapling, punching, saddle stitching, or the like, on sheets that are printed by the printing unit 212 and discharged. The image processing unit 213 performs image processing such as resizing, rotation, color conversion, smoothing, or the like, on images scanned by the scanner unit 210, print data received by the network I/F 206, or the like.

<Printing Apparatus Software Configuration>

Figure 3:
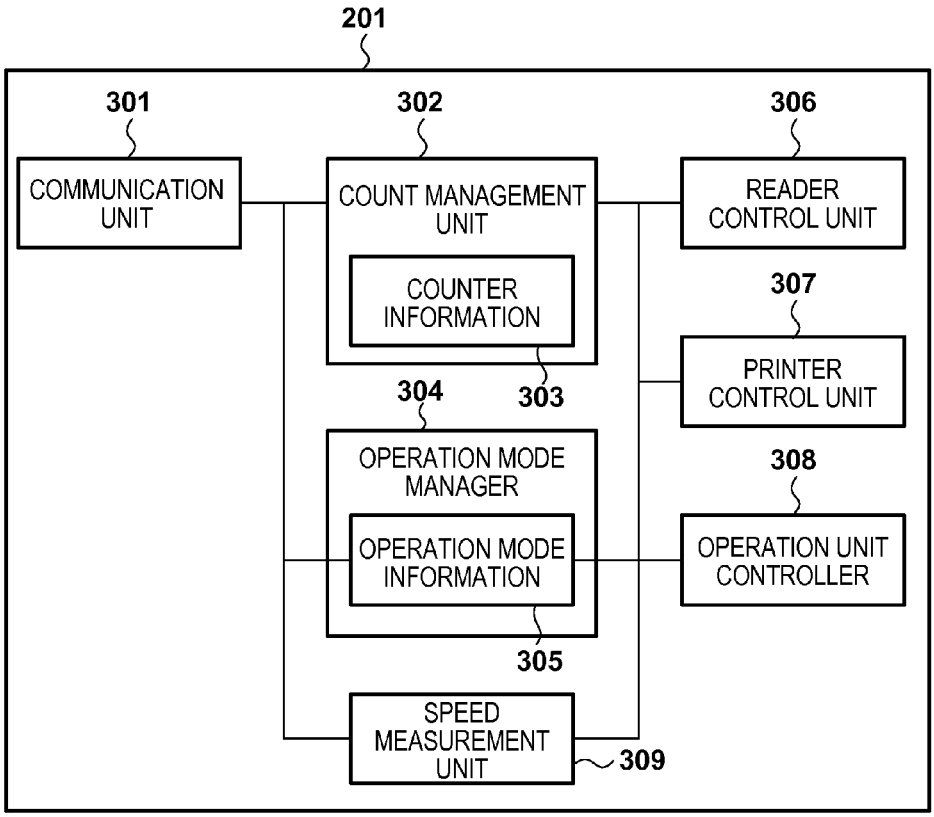
FIG. 3 is a view illustrating a software configuration of the printing apparatus.

Next, with reference to FIG. 3, explanation will be given for a software configuration for counter management processing of the printing apparatus in the present embodiment.

Reference numerals 301-302, 304, and 306-309 denote program modules that are stored in the ROM 204, loaded into the RAM 203, and executed. A communication unit 301 performs communication with the management server 107 via the network I/F 206. A count management unit 302 manages parameter measurement values relating to image formation using counter information 303 arranged in the HDD 205. The counter information 303 is data shown in FIG. 4, for example. Details will be explained later using FIG. 4.

The count management unit 302 increments a counter managed by the counter information 303 upon an event output from a speed measurement unit 309. The speed measurement unit 309 measures reading speed and printing speed based on discharge events from a reader control unit 306 and a printer control unit 307, or the like, and communicates a number of sheets, the reading speed or the printing speed to the count management unit 302. The reading speed and the printing speed represent the number of sheets read in 1 minute (ipm) or the number of print sheets in 1 minute (ppm), and can be obtained by the following equation.

$$\text{Reading speed (ipm)} = 60\ \text{(sec)} / \text{reading interval (sec/page)} \quad (1)$$

$$\text{Printing speed (ppm)} = 60\ \text{(sec)} / \text{discharge interval (sec/page)} \quad (2)$$

The count management unit 302, upon reading or printing events, increments the counter of the counter information 303 in accordance with the speeds of the above-described (1) or (2).

The reading speed and the printing speed may be measured for each sheet as described above, or may be measured by the job (scan job, print job, etc.). The reader control unit 306 controls the scanner unit 210, and notifies the speed measurement unit 309 of events in order to increment the counter information 303. The printer control unit 307 controls the printing unit 212 and the post processing unit 215, and notifies the speed measurement unit 309 of events in order to increment the counter information 303. An operation unit controller 308 controls the operation unit 208 via the operation unit I/F 207. The operation unit controller 308 receives operation instructions made on the printing apparatuses 102-104 by receiving input from the hardware keys or the touch panel of the operation unit 208. Also, the operation unit controller 308 displays statuses of the printing apparatuses 102-104, the counter information 303, or the like, to the touch panel. An operation mode manager 304 manages operation mode information 305 which is related to the operation of the reader control unit 306, the printer control unit 307, or the like. The operation mode information 305 may be various kinds of operation modes of the printing apparatuses 102-104; for example it may be an engine speed, image processing parameters, software license information, or the like. The operation mode information 305 is held in the ROM 204, and while it is not normally changed, it is changed upon an installation of software options for the printing apparatuses 102-104, or the like.

<Counter Information>

Next, with reference to FIG. 4, explanation will be given for internal data of counter information which is related to printing by the printing apparatuses in the present embodiment. Reference numeral 400 denotes counters which are related to the number of sheets of paper (printing mediums) printed for each speed. Reference numeral 410 denotes counters which indicate use counts for respective components in the printing apparatus.

A speed 401 indicates counters for each printing speed. For a print type 402, counters corresponding to print jobs are arranged for black and white small, black and white large, color small, and color large for each of the speed 401. A counter 403 corresponds to numerical value counters which correspond to the speed 401 and the print type 402. For the speed 401 there is a speed A which is a high speed, a speed B which is a normal speed, and a speed C which is a low speed. The types of speeds here are only one example, and they may be divided more finely, or there may be less types.

Upon counting the number of print sheets, it is determined which speed's counter to increment based on information of the previously described speed measurement unit 309. A component 404 denotes counters for each component in the printing apparatus. A component counter 405 denotes the number of times each component has actually been used for printing.

First Embodiment

Figure 5:
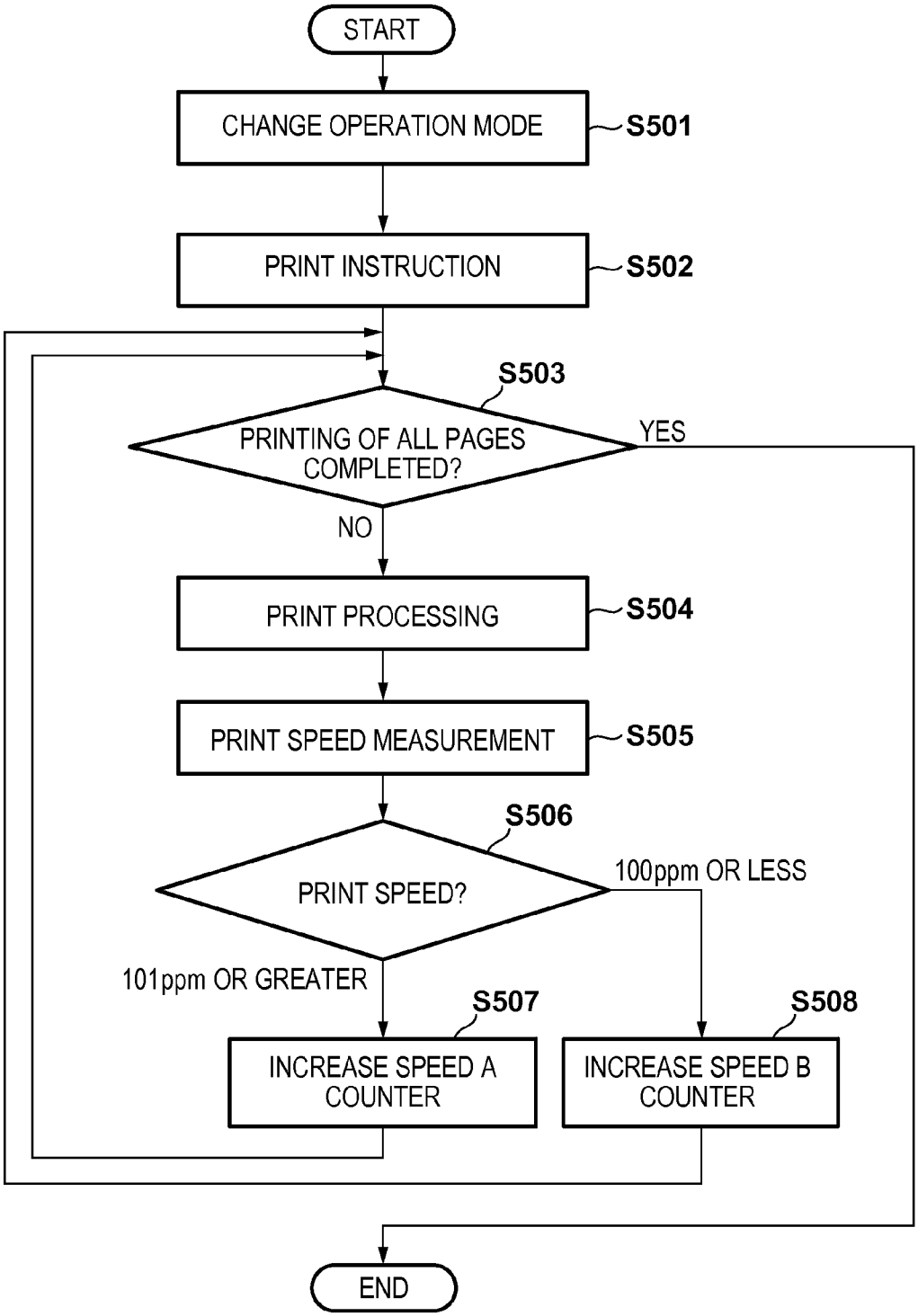
FIG. 5 is a flowchart according to a first embodiment.

Next, explanation will be given for a processing procedure according to the first embodiment with reference to FIG. 5. In the present embodiment, a printing apparatus whose normal printing speed is 100 ppm will be used as an example. The processing explained below is performed by the CPU 202 executing a control program which is stored in advance in the ROM 204, the HDD 205, or the like, and which is read into the RAM 203. Here, the normal printing speed indicates a rated printing speed in the printing apparatus.

In step S501, the operation mode manager 304 changes the operation mode upon the installation of a software option. More specifically, the operation mode manager 304 changes (sets) a maximum value for the printing speed from 100 ppm to 120 ppm in the operation mode information 305. The 120 ppm here is only one example, and the intention is not to limit the present invention. Note that the printer control unit 307 is notified that the printing speed is raised to 120 ppm. The printer control unit 307, having received the notification, switches to settings necessary to print at 120 ppm, such as those for a motor that drives a roller for sheet conveyance, and for a motor that drives a photosensitive drum necessary for image formation.

In step S502, the CPU 202 receives a print job from a user via the communication unit 301 and the operation mode manager 304. In the reception of the print job, a print instruction for performance of printing and image data are included. Note that there are cases in which the printing apparatus 102, or the like, holds image data that is the target of the printing in advance, and cases in which the image data is read from an original and only the print instruction is received or accepted. In step S503, the printer control unit 307 determines whether or not the printing of all pages in the print job received in step S502 has completed. When, in step S503, it is determined that all pages have completed, the processing terminates. In a case where it is determined that the printing of all pages has not completed in step S503, the processing proceeds to step S504. In step S504, the printer control unit 307 performs the printing of the received print job.

In step S505, the speed measurement unit 309 receives events for each page printed from the printer control unit 307, and measures the printing speed for each sheet using the intervals of the received events, i.e. using previously described Equation 2 with the printing interval. In step S506, the count management unit 302 determines which speed's counter to increment based on the printing speed that the speed measurement unit 309 measured in step S505. In the present embodiment it is assumed that there are a speed A counters for 101 ppm or greater, and there are speed B counters for 100 ppm or less. The processing proceeds to step S507 in a case where an event is received for 101 ppm or greater in step S506, and the processing proceeds to step S508 in a case where an event is received for 100 ppm or less. In step S507, the count management unit 302 increments a speed A counter corresponding to the type of the page. In step S508 a speed B counter is incremented similarly to step S507. In other words, in the present embodiment a speed A counter is incremented in a case where the printing speed corresponding to the set operation mode is reached, and a speed B counter is incremented in a case where the printing speed is not reached.

As explained above, by incrementing the counter in accordance with the actual speed for each printing medium it is possible to know the number of sheets of printing mediums that can be printed at the actual raised speed in an operation mode in which the printing speed is raised. With this, it becomes possible to make charges in accordance with the actual printing speed (print result) rather than making the same charges uniformly in an operation mode in which the printing speed is raised. The method of calculating the charging amount may be to obtain it by the following equation, for example.

$$\text{Charging amount}=(\text{speed } A \text{ counter})*\alpha+(\text{speed } B \text{ counter})*\beta \quad (3)$$

($\alpha$ and $\beta$ are appropriate coefficients)

Also, two types of counters in the present embodiment are given as an example here, and the number of counters may be increased in order to grasp the information more finely.

Second Embodiment

Figure 6:
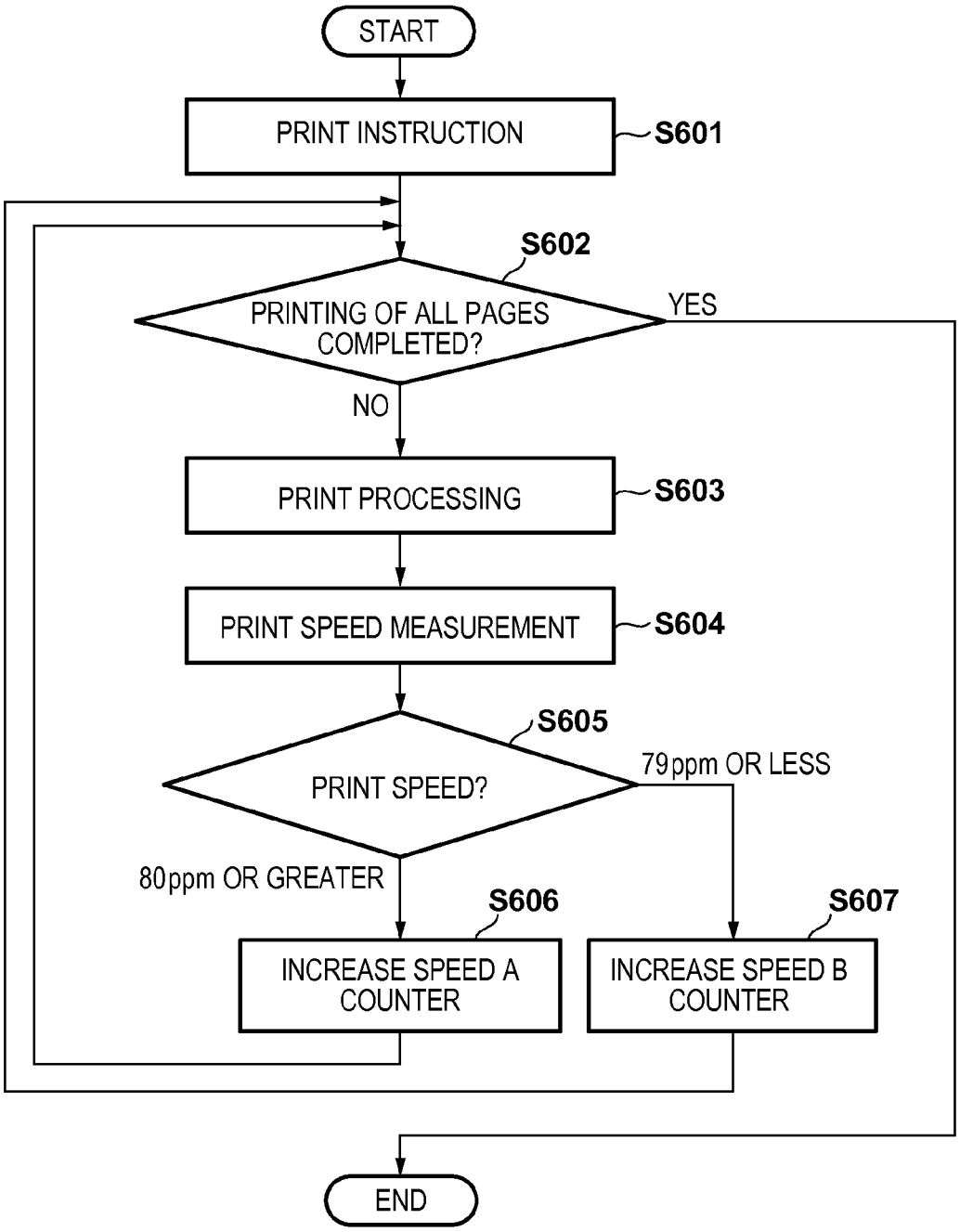
FIG. 6 is a flowchart according to a second embodiment.

Next, explanation will be given for a processing procedure according to the second embodiment with reference to FIG. 6. In the present embodiment, a printing apparatus whose normal printing speed is 100 ppm will be used as an example. The processing explained below is performed by the CPU 202 executing a control program which is stored in advance in the ROM 204, the HDD 205, or the like, and which is read into the RAM 203.

In step S601, the CPU 202 receives a print job from a user via the communication unit 301 and the operation mode manager 304. In step S602, the printer control unit 307 determines whether or not the printing of all pages in the print job received in step S601 has completed. When, in step S602, it is determined that all pages have completed, the processing terminates. Meanwhile, in a case where it is determined that the printing of all pages has not completed in step S602, the processing proceeds to step S603. In step S603, the printer control unit 307 performs the printing of the received print job. In step S604, the speed measurement unit 309 receives events for each page printed from the printer control unit 307. The printing speeds of each sheet are measured using the intervals between the received events, i.e. using the previously described Equation 2 with the printing intervals. In step S605, the count management unit 302 receives the printing speed that the speed measurement unit 309 measured in step S604 and determines which speed's counter to increment.

In the present embodiment it is assumed that speed A counters for 80 ppm or greater is held, and speed B counters for 79 ppm or less is held. The processing proceeds to step S606 in a case where an event is received for 80 ppm or greater in step S605, and the processing proceeds to step S607 in a case where an event is received for 79 ppm or less in step S605. In step S606, the count management unit 302 increments a speed A counter in accordance with the type of the page. In step S607, the count management unit 302 increments a speed B counter similarly to step S606.

As explained above, by incrementing the counter in accordance with the actual speed, it becomes possible to know of a case in which the actual speed is a normal printing speed or less from the printing speed of the printer. Also, even if printing is being performed at the normal printing speed, it is possible to control charging similarly to in the first embodiment by matching it to the actual printing speed.

Third Embodiment

Figure 7:
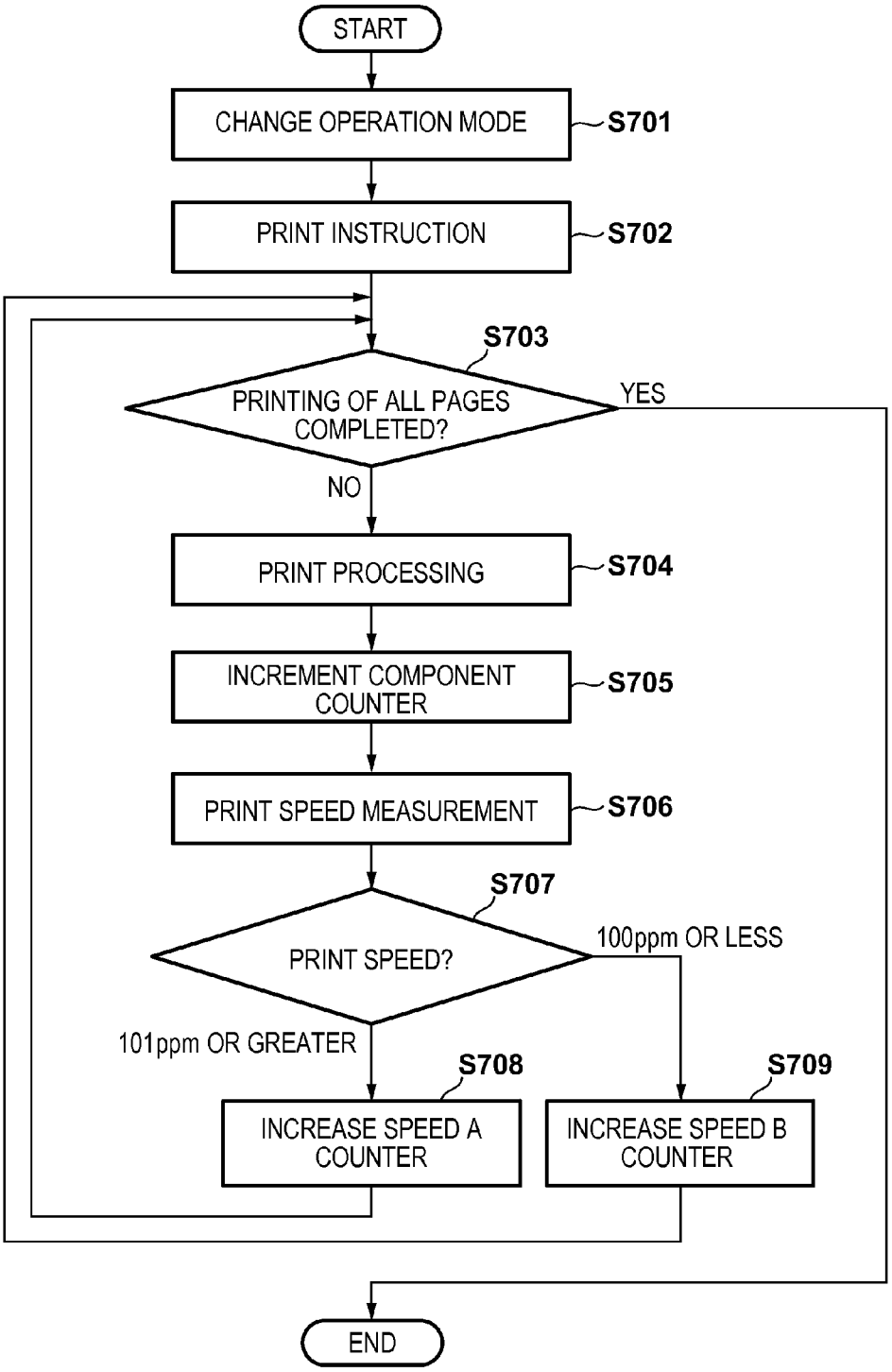
FIG. 7 is a flowchart according to a third embodiment.

Next, explanation will be given for a third embodiment with reference to FIG. 7. The count management unit 302, in addition to counters of the number of print sheets for each printing speed as in the foregoing first and second embodiments, has counters for each of the components as in reference numeral 410 of FIG. 4. The processing explained below is performed by the CPU 202 executing a control program which is stored in advance in the ROM 204, the HDD 205, or the like, and which is read into the RAM 203. Note that step S701-step S704 are for the same processing as step S501-step S504 of the above described first embodiment, and so explanation thereof will be omitted.

In step S705, the printer control unit 307 transmits information of components that are used in the printing of step S704 to the count management unit 302. The count management unit 302 increments the counter information in accordance with the received information. Step S706-step S709 is the same as step S505-step S508 in the above described first embodiment, and so it is omitted.

As explained above, there are sheet counters (component counters) for each component which are similar to the counters of the number of print sheets for each speed. Accordingly, it becomes possible to calculate a consumption level for components by the following equation based on a speed B counter, which is for the normal speed, in a case where the consumption level of components differs in accordance with the printing speed.

$$\text{Consumption level}=(\text{component counter})*((\text{speed } A \text{ counter})*\alpha+(\text{speed } B \text{ counter})) \quad (4)$$

Here $\alpha$ indicates a coefficient for a weight of the consumption level corresponding to the speed.

Configuration may be taken such that it is possible to confirm the consumption level by calculation by the CPU 202, and display to the operation unit controller 308. Also, configuration may be taken such that by the counter information being transmitted to the management server 107 via the information processing apparatus 106, the consumption level is calculated by the management server. With this, it becomes possible to calculate the consumption level of components without arranging counters for each speed and for each component, and it becomes possible to economize a storage region such as an HDD.

Fourth Embodiment

The above-described third embodiment is applicable to cases in which all component counters are used irrespective of the print type, but it is not applicable in cases in which there are components that are only used for a portion of the print types. In the fourth embodiment, a table 800 that associates components and print types, as is shown in FIG. 8, is arranged rather than arranging the component counter as is shown in reference numeral 410.

In the present embodiment, it is possible to calculate the consumption level for a component A by the following equation.

$$\text{Consumption level}=(\text{speed}A,\text{black and white, small}*\alpha+\text{speed}B,\text{black and white,small}*\beta+\text{speed}C,\text{black and white,small}*\gamma)+(\text{speed}A,\text{color, small}*\delta+\text{speed}B,\text{color,small}*\epsilon+\text{speed}C,\text{color, small}*\zeta) \quad (5)$$

Here, $\alpha$, $\beta$, $\gamma$, $\delta$,$\epsilon$, and $\zeta$ indicate coefficients which are weights for the consumption levels corresponding to the respective speeds and component types.

As explained above, in the present embodiment, in addition to the above-described third embodiment, it is possible to further arrange a plurality of types for the component counters. Accordingly, in the present embodiment, it becomes possible to calculate the consumption level more accurately even in a case where the ways in which the components are used differs depending on the print type.

As described above, for the foregoing first through fourth embodiments, it is possible to manage the printing apparatuses 102-104 by the management server 107 by the printing apparatuses 102-104 transmitting the counter information to the management server 107 via the information processing apparatus 106. Also, the number of printing apparatuses is not limited to 3 (reference numerals 102-104); more printing apparatuses may be connected.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like. While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-143658 filed on Jul. 11, 2014, which is hereby incorporated by reference herein in its entirety.

What is claimed is:

1. A printing apparatus capable of printing an image on at least one sheet of a predetermined type, comprising:

a printing unit;

a controller which includes at least a processor and a memory, configured to function as:

a setting unit configured to set an operation mode in which the printing unit prints the at least one sheet in accordance with a second predetermined process speed, which is faster than a first predetermined process speed, the operation mode being set by an activation of a function that raises the process speed for the printing unit that prints the at least one sheet of the predetermined type from the first predetermined process speed to the second predetermined process speed;

a plurality of storage units including a first storage unit and a second storage unit, each of the plurality of storage units storing an accumulated number of printed sheets and corresponding to different printing speed ranges, wherein the first storage unit stores an accumulated number of sheets having been printed at a printing speed within a first printing speed range and the second storage unit stores an accumulated number of sheets having been printed at a printing speed within a second printing speed range, and wherein the printing speed within the first printing speed range can be reached before the activation of the function and the printing speed within the second printing speed range, faster than the printing speed within the first printing speed range, cannot be reached before the activation of the function;

a determination unit configured to determine a printing speed of the at least one sheet having been printed in the set operation mode, in accordance with the second predetermined process speed, by detecting a discharge event of the at least one sheet printed in the set operation mode, wherein the second predetermined process speed can be different from the printing speed;

a selection unit configured to select one storage unit among the plurality of storage units based on the determined printing speed, wherein the selection unit selects the first storage unit if the determined printing speed falls within the first printing speed range and selects the second storage unit if the determined printing speed falls within the second printing speed range; and an update unit configured to update the accumulated number of printed sheets having been stored in the selected one storage unit by adding a number of the at least one sheet to the accumulated number of printed sheets stored in the selected one storage unit.

2. The printing apparatus according to claim 1, wherein the determination unit further detects a discharge event of a last sheet of the at least one sheet, checks an interval between detection timings for the at least one sheet, and determines the printing speed in accordance with the checked interval.

3. The printing apparatus according to claim 1, wherein the accumulated number of printed sheets stored in the plurality of storage units is used for calculating a charging amount.

4. The printing apparatus according to claim 1, wherein the process speed is related to an engine speed of the printing unit and is not related to contents of the image, and the printing speed is dependent on the engine speed and the contents of the image.

5. A method of controlling a printing apparatus which is capable of printing an image on at least one sheet of a predetermined type and comprises a printing unit, a controller which includes at least a processor and a memory, configured to function as: a plurality of storage units including a first storage unit and a second storage unit, each of the plurality of storage units storing an accumulated number of printed sheets and corresponding to different printing speed ranges, the method comprising:

setting an operation mode in which the at least one sheet is printed in accordance with a second predetermined process speed, which is faster than a first predetermined process speed, the operation mode being set by an activation of a function that raises the process speed for the printing unit that prints the at least one sheet of the predetermined type from the first predetermined process speed to the second predetermined process speed, wherein the first storage unit stores an accumulated number of sheets having been printed at a printing speed within a first printing speed range and the second storage unit stores an accumulated number of sheets having been printed at a printing speed within a second printing speed range, and wherein the printing speed within the first printing speed range can be reached before the activation of the function and the printing speed within the second printing speed range, faster than the printing speed within the first printing speed range, cannot be reached before the activation of the function;

determining a printing speed of the at least one sheet having been printed in the set operation mode, in accordance with the second predetermined process speed, by detecting a discharge event of the at least one sheet printed in the set operation mode, wherein the second predetermined process speed can be different from the printing speed;

selecting one storage unit among the plurality of storage units based on the determined printing speed, wherein the selection unit selects the first storage unit if the determined printing speed falls within the first printing speed range and selects the second storage unit if the determined printing speed falls within the second printing speed range; and updating the accumulated number of printed sheets having been stored in the selected one storage unit by adding a number of the at least one sheet to the accumulated number of printed sheets stored in the selected one storage unit.

6. A non-transitory computer-readable storage medium storing a computer program for causing a computer to execute a method of controlling a printing apparatus which is capable of printing an image on at least one sheet of a predetermined type and comprises a printing unit, a controller which includes at least a processor and a memory, configured to function as: a plurality of storage units including a first storage unit and a second storage unit, each of the plurality of storage units storing an accumulated number of printed sheets and corresponding to different printing speed ranges, the method comprising:

setting an operation mode in which the at least one sheet is printed in accordance with a second predetermined process speed, which is faster than a first predetermined process speed, the operation mode being set by an activation of a function that raises the process speed for the printing unit that prints the at least one sheet of the predetermined type from the first predetermined process speed to the second predetermined process speed, wherein the first storage unit stores an accumulated number of sheets having been printed at a printing speed within a first printing speed range and the second storage unit stores an accumulated number of sheets having been printed at a printing speed within a second printing speed range, and wherein the printing speed within the first printing speed range can be reached before the activation of the function and the printing speed within the second printing speed range, faster than the printing speed within the first printing speed range, cannot be reached before the activation of the function;

determining a printing speed of the at least one sheet having been printed in the set operation mode, in accordance with the second predetermined process speed, by detecting a discharge event of the at least one sheet printed in the set operation mode, wherein the second predetermined process speed can be different from the printing speed;

selecting one storage unit among the plurality of storage units based on the determined printing speed, wherein the selection unit selects the first storage unit if the determined printing speed falls within the first printing speed range and selects the second storage unit if the determined printing speed falls within the second printing speed range; and updating the accumulated number of printed sheets having been stored in the selected one storage unit by adding a number of the at least one sheet to the accumulated number of printed sheets stored in the selected one storage unit.

* * * * *